US005557585A

United States Patent [19]

Hanai et al.

[11] Patent Number: 5,557,585

[45] Date of Patent: Sep. 17, 1996

[54] BROADCAST SIGNAL RECEIVER WHICH AUTOMATICALLY SETS AN INTERNAL CLOCK

[75] Inventors: Tomoyuki Hanai, Kanagawa; Kimio Kakurai; Kenji Hamamoto, both of Tokyo, all of Japan

[73] Assignee: Sony Corp., Tokyo, Japan

[21] Appl. No.: 293,917

[22] Filed: Aug. 22, 1994

[30] Foreign Application Priority Data

Aug. 25, 1993 [JP] Japan ..... 5-210605
Sep. 7, 1993 [JP] Japan ..... 5-222352

[51] Int. Cl.[6] ..... G04G 9/00

[52] U.S. Cl. ..... 368/43; 368/10

[58] Field of Search ..... 368/47, 10, 48–61

[56] References Cited

U.S. PATENT DOCUMENTS 3,811,265 5/1974 Cater .
4,117,661 10/1978 Bryant, Jr. ..... 368/47
4,582,434 4/1986 Plangger et al. ..... 368/46
4,635,121 1/1987 Hoffman et al. .
4,823,328 4/1989 Conklin et al. ..... 368/47
4,993,003 2/1991 Fechner et al. ..... 368/47
5,329,500 7/1994 Baik et al. ..... 368/47
5,334,975 8/1994 Achob et al. ..... 368/47

FOREIGN PATENT DOCUMENTS 0355567 2/1990 European Pat. Off. .
0498199 8/1992 European Pat. Off. .
0562410 9/1993 European Pat. Off. .
0607814 7/1994 European Pat. Off. .
2226157 12/1988 United Kingdom ..... 368/47

*Primary Examiner*—Bernard Roskoski
*Attorney, Agent, or Firm*—William S. Frommer; Alvin Sinderbrand

[57] ABSTRACT

Broadcast signal receiver which has an internal clock controls an internal or external tuner which receives a plurality of broadcast signals to tune to a predetermined broadcast signal which includes time data indicating a local time. The broadcast signal tuned to is supplied as a tuned output signal. The time data is extracted from the tuned output signal and the internal clock of the broadcast signal receiver is automatically set to the local time indicated by the time data.

34 Claims, 7 Drawing Sheets

BROADCAST SIGNAL RECEIVER WHICH AUTOMATICALLY SETS AN INTERNAL CLOCK

BACKGROUND OF THE INVENTION

The present invention relates to a broadcast signal receiver and, more particularly, to an apparatus and method for automatically setting an internal clock in a broadcast signal receiver.

As is known, current video tape recorders include an internal clock which identifies the current date and time, and which is operable to be used in conjunction with a programmed record setting which provides the function of allowing a user to set the video tape recorder to record a video signal transmitted over a designated channel at a specific future date or time. Currently, the internal clock of a video tape recorder is manually set by users who perform various steps specific to this time setting operation. Since timer recording of a video tape recorder operates as a function of the time indicated by its internal clock, the internal clock must be both manually and correctly set by the user in order for the proper "time" recording of "programmed" broadcast signals.

One problem encountered in a typical video tape recorder is the general difficulty in setting its internal clock. Because of such difficulty, many users elect to not set the internal clock which results in a constant display of 12:00 PM on the video tape recorder's display. Besides providing an undesirable display, an internal clock which has not been properly set obviates the effective use of the video tape recorder's program recording functions. Another difficulty with current video tape recorders is the necessity of adjusting (i.e., resetting) the internal clock when it stores an incorrect time. Such an incorrect stored internal time may be caused by the removal of power to the video tape recorder (and without a proper back up power supply), incorrect time keeping by the internal clock, or a change between daylight savings time and standard time. In such cases, the video tape recorder user must again set the internal clock to the correct time. In addition, an incorrect clock results in an incorrect recording time when recording is initiated via a timer record function.

Patents which relate to the present invention include U.S. Pat. Nos. 4,329,684, 4,390,901, 4,499,179, and 4,635,121.

OBJECTS OF THE INVENTION

Therefore, it is an object of the present invention to provide broadcast signal receiver in which an internal clock is set automatically.

Another object of the present invention is to provide apparatus and corresponding method wherein an internal clock is automatically set, thereby eliminating the need to manually set that clock.

A further object of the present invention is to automatically sat the internal clock of a broadcast signal receiver in the event the internal clock displays an incorrect time.

An additional object of this invention is to automatically set the internal clock of a broadcast signal receiver when the current local time is different from the time indicated by the internal clock due, for example, to a change between daylight savings time and standard time.

Various other objects, advantages and features of the present invention will become readily apparent to those of ordinary skill in the art, and the novel features will be particularly pointed out in the appended claims.

SUMMARY OF THE INVENTION

In accordance with one embodiment of the present invention, a broadcast signal receiver (e.g., video tape recorder) which has an internal clock, is tuned to a broadcast signal having time data which indicates the local time. The tuned broadcast signal is supplied as a tuned output signal from which the time data is extracted and used to automatically set the internal clock of the broadcast signal receiver to the local time indicated by the time data.

As various aspects of the present invention, the internal clock is set to the local time after the broadcast signal receiver is turned off, when the internal clock is set to the local time at some predetermined time, when the difference between the internal clock time and the local time is below a predetermined threshold amount, when the difference between a programmed time for recording and the internal clock time is greater than another predetermined threshold amount, when the internal clock was not previously set, or when there is a change in the local time between daylight savings time and standard time.

BRIEF DESCRIPTION OF THE DRAWINGS

The following detailed description, given by way of example and not intended to limit the present invention solely thereto, will best be appreciated in conjunction with the accompanying drawings, wherein like reference numerals denote like elements and parts in which.

DETAILED DESCRIPTION OF CERTAIN PREFERRED EMBODIMENTS

Figure 1:
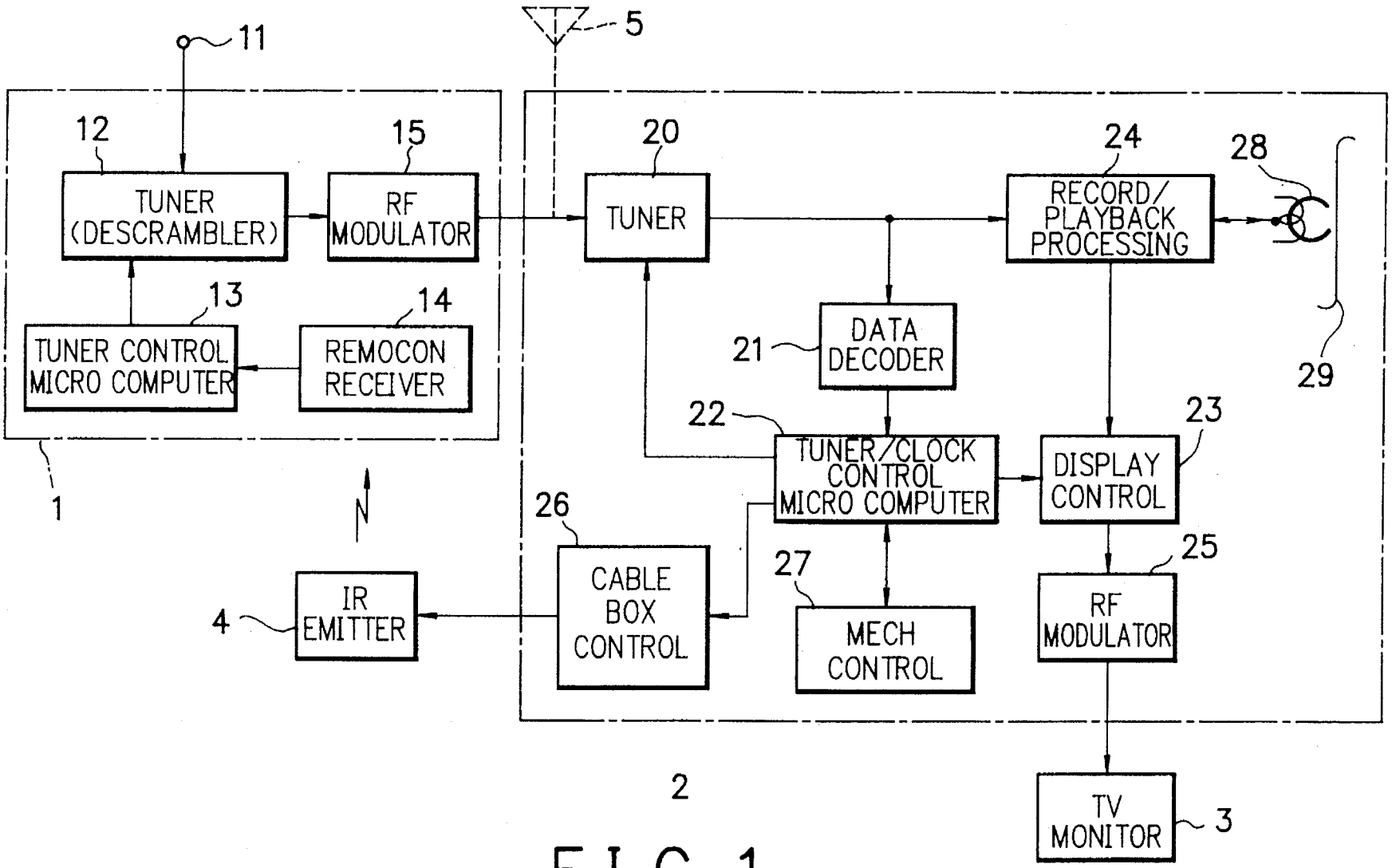
FIG. 1 is a block diagram of a cable box and a video tape recorder in which the present invention finds ready application.

Referring now to the drawings, FIG. 1 shows broadcast signal receiver apparatus in accordance with the present invention, including a cable box 1 and a video tape recorder 2. Cable box 1 provides external broadcast signal receiving and tuning means and includes a tuner 12, a tuner control microcomputer 13, a remote control receiver 14, and an RF modulator 15. Tuner 12 receives a cable television (CATV) signal which is supplied to input terminal 11, as from a cable broadcasting company. In addition to tuning to a selected channel, tuner 12 generally is further operable to descramble selected scrambled channels. Tuner 12 tunes to a selected channel of the CATV signal in accordance with a control signal supplied by tuner control microcomputer 13, the channel being selected by a user and represented by a control signal supplied by remote control receiver 14. Remote control receiver 14 receives a remote control signal (e.g., an infrared signal) from a remote control unit 4 (to be described) operated by the user. Tuner 12 tunes to the selected channel and supplies the corresponding video signal to RF modulator 15 which converts the video signal into a broadcast signal. The broadcast signal is supplied to video tape recorder 2. The operation of cable box 1 is well known in the art, and therefore, further description of such operation is omitted, except where necessary for an understanding of the present invention.

Video tape recorder 2 is comprised of a tuner 20, a data decoder 21, a tuner/clock control microcomputer 22, a display control 23, a record/playback processing circuit 24, an RF modulator 25, a cable box controller 26, a mechanical controller 27, and magnetic heads 28. Tuner 20 is operable to receive the broadcast signal supplied by cable box 1, and is also operable to receive broadcast signals supplied by an external antenna 5. Tuner 20 tunes to a selected channel in accordance with a control signal supplied thereto by microcomputer 22, and supplies the signals on the selected channel to data decoder 21 and record/playback processing circuit 24. It is appreciated that tuner 20 performs a tuning function similar to that performed by tuner 12 in cable box 1.

Figure 2A:
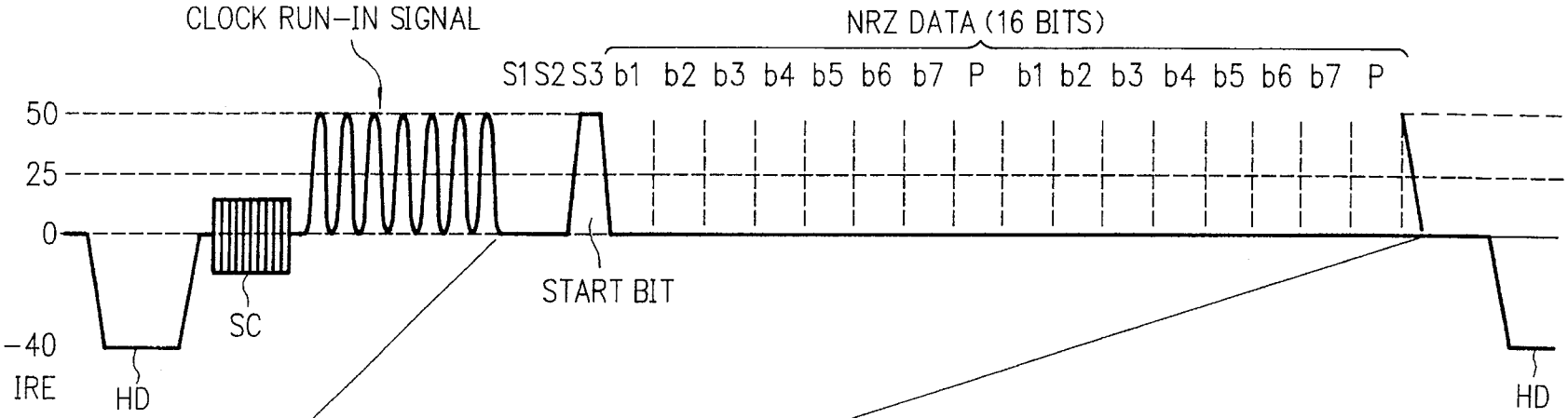
FIG. 2A is a timing diagram of a broadcast video signal and FIG. 2B is a schematic diagram illustrating the types of data supplied in the broadcast signal.

The broadcast signal, which is an NTSC video signal, supplied to data decoder 21 may contain "captioned" data inserted into predetermined horizontal lines of each vertical line interval of the NTSC video signal. FIG. 2A illustrates an NTSC video signal having captioned data. As shown, a predetermined line interval in the vertical blanking interval is comprised of a horizontal synchronizing signal HD followed by a color burst signal SC, seven cycles of a clock run-in signal (503 KHz), three bits S1, S2 and S3, and 16 bits of data known as "NRZ" data. The clock run-in signal provides synchronization for the reading of the NRZ data which follows bits S1–S3 formed of two low bits S1 and S2 and high bit S3 (i.e., the start bit). The NRZ data is composed of two 8 bit groups wherein each group includes a seven bit ASCII character b1–b7 and a parity bit p.

Returning to FIG. 1, data decoder 21 extracts the NRZ data from the video signal and decodes the NRZ data (which may be represented as a hexadecimal code) into a binary coded decimal (BCD) code. The decoded captioned data is supplied to microcomputer 22 which stores the decoded captioned data in a random access memory (RAM) (not shown). Microcomputer 22 supplies the captioned data to display control circuit 23 which converts the decoded captioned data into character data (e.g., dot data), and microcomputer 22 also supplies to display control circuit 23 a position control signal which indicates the location at which the character data is to be superimposed on the video image. The position control signal represents a desired position of the video picture, e.g. left top corner, right top corner, left bottom corner, right bottom corner, center, etc. Display control circuit 23 receives from record/playback processing circuit 24 the broadcast video signal and superimposes the character data (i.e., captioned data) on the video signal at the position indicated by the position control signal. The resulting video signal is supplied to RF modulator 25 which converts the video signal and superimposed character data into a signal displayable on television monitor 3. Accordingly, character data or "captions" are superimposed on broadcast video signals displayed on television monitor 3.

Microcomputer 22 further operates as a channel selection controller which supplies a selected channel control signal to cable box controller 26, the selected channel being either a manually selected channel (e.g., a user manually selects the channel via a remote control device) or a preprogrammed channel. In response to the control signal from microcomputer 22, cable box controller 26 supplies a control drive signal to remote control unit 4, which supplies a remote control signal to cable box 1, and this, in turn, operates to tune the cable box to the selected channel as previously described. In addition to controlling the channel selection (i.e. tuning) by tuner 12 in cable box 1 and tuner 20 of video tape recorder 2, microcomputer 22 further is operable to provide power on and off control of cable box 1 via cable box controller 26 and remote control unit 4. In addition, microcomputer 22 is operable to set an internal clock included in the tuner/clock control of microcomputer 22.

Mechanical controller 27 provides the drive control of the recording/reproducing heads, and video and tape feeder portions of video tape recorder 2, the operation of which being well known in the art. For example, the mechanical controller controls play, fast forward, rewind, slow motion, record and similar functions.

During a recording operation of video tape recorder 2, record/playback processing circuit 24 process the video signal supplied by tuner 20 to form a record signal. A magnetic head 28 of video tape recorder 2 records the record signal onto a magnetic tape 29 loaded into video tape recorder 2. Similarly, during a playback operation of video tape recorder 2, record/playback processing circuit 24 in conjunction with magnetic head 28 reproduces the video signal recorded on magnetic tape 29, and supplies the reproduced video signal to display control circuit 23. The video signal may then be displayed on television monitor 3 via RF modulator 25.

Referring back to FIG. 2A, captioned data is multiplexed on selected horizontal lines of each (or selected) vertical line interval of the broadcast video signal. Other "special" information, known as VBI data, may similarly be multiplexed onto the broadcast signal. VBI data may include, for example, time data indicating the current time of day and whether the current time is daylight savings time or standard time, as well as, current and future program information which may include a program's start time, its elapsed time, and its content. VBI data may further include information about the station broadcasting the broadcast signal, as well as, weather and news information.

Figure 2B:
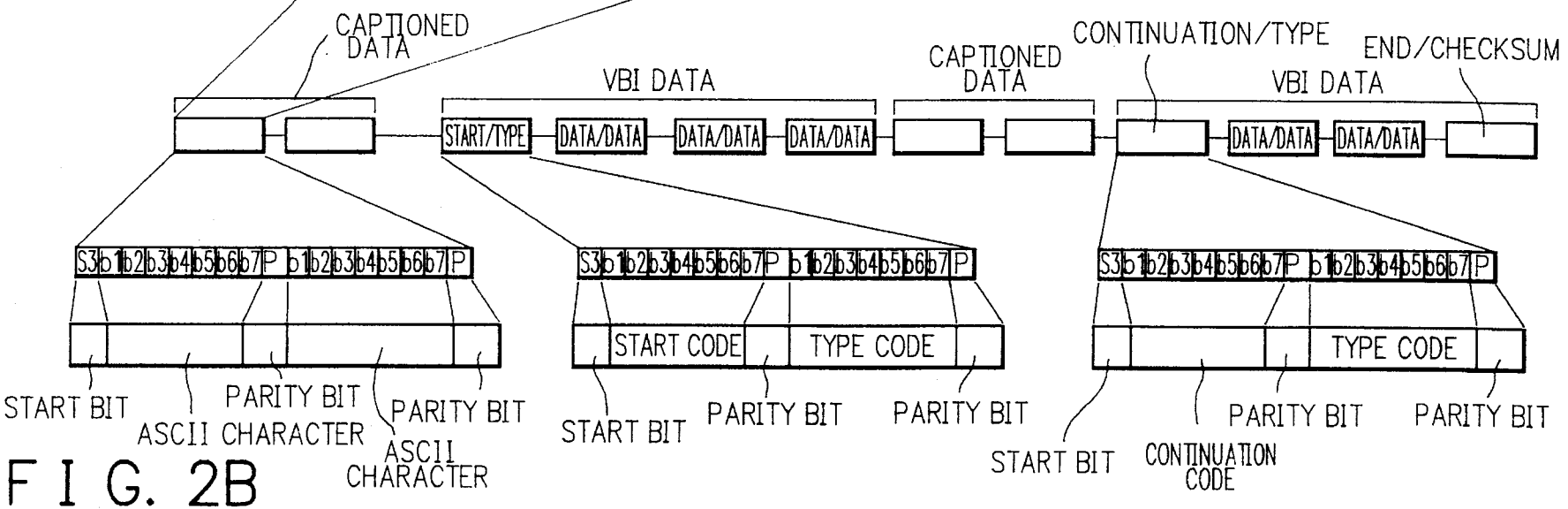

FIG. 2B illustrates the data structure of captioned data and VBI data included in a vertical line interval of the broadcast signal. As shown, VBI data multiplexed in a horizontal line interval of the vertical line interval is composed of 16 bits of NRZ data, which includes 7 bits of data b1 to b7, a parity bit p, followed by another 7 bits of data b1 to b7 and another parity bit p. These first 16 bits of VBI data, which represent a first "line", indicate a start code and the type of VBI data. In particular, the first 7 bits b1 to b7 indicate a "class" of the VBI data (to be described), and the latter 7 bits b1 to b7 identify the type of data within the indicated class. Successive VBI data in following lines of the vertical blanking interval (i.e., the successive lines) represent data pertaining to the class/type identified in the first line of the VBI data.

If the transmission of VBI data is interrupted by the transmission of captioned data, the transmission of the remaining VBI data will continue upon termination of the captioned data transmission. In this instance, the first 7 bits of VBI data which follows the captioned data represents a continuation code, and is followed by the seven bits b1 to b7 which repeat the type of the VBI data. Upon completion of the transmission of the VBI data, one final line of VBI data is transmitted which includes a 7 bit end code, a parity bit, a 7 bit checksum code and another parity bit.

Examples of VBI data classes include "current program information" and "future program information", and the type of data that may be available in each class includes "program start time", "length/time elapsed", "program title", "program type", "program audience", etc. Another class is "channel information" which represents special information about the selected channel (other than the broadcast program) and the type of data that may be available in this class includes "network name", "station ID", "tape delay" (which represents the delay in hours and minutes of the network program delivered for broadcast by the local station), etc. The VBI data may also be identified by the class "miscellaneous information", and the type of data that may be available in this class includes "Greenwich time", "local time zone", "daylight savings time use", etc. Another possible class is "public service/weather service/message", and the type of data that may be available in this class includes "weather service". The present invention is primarily concerned with data included in the "miscellaneous information" class, and hereinafter this data is identified as "time data".

Figure 3:
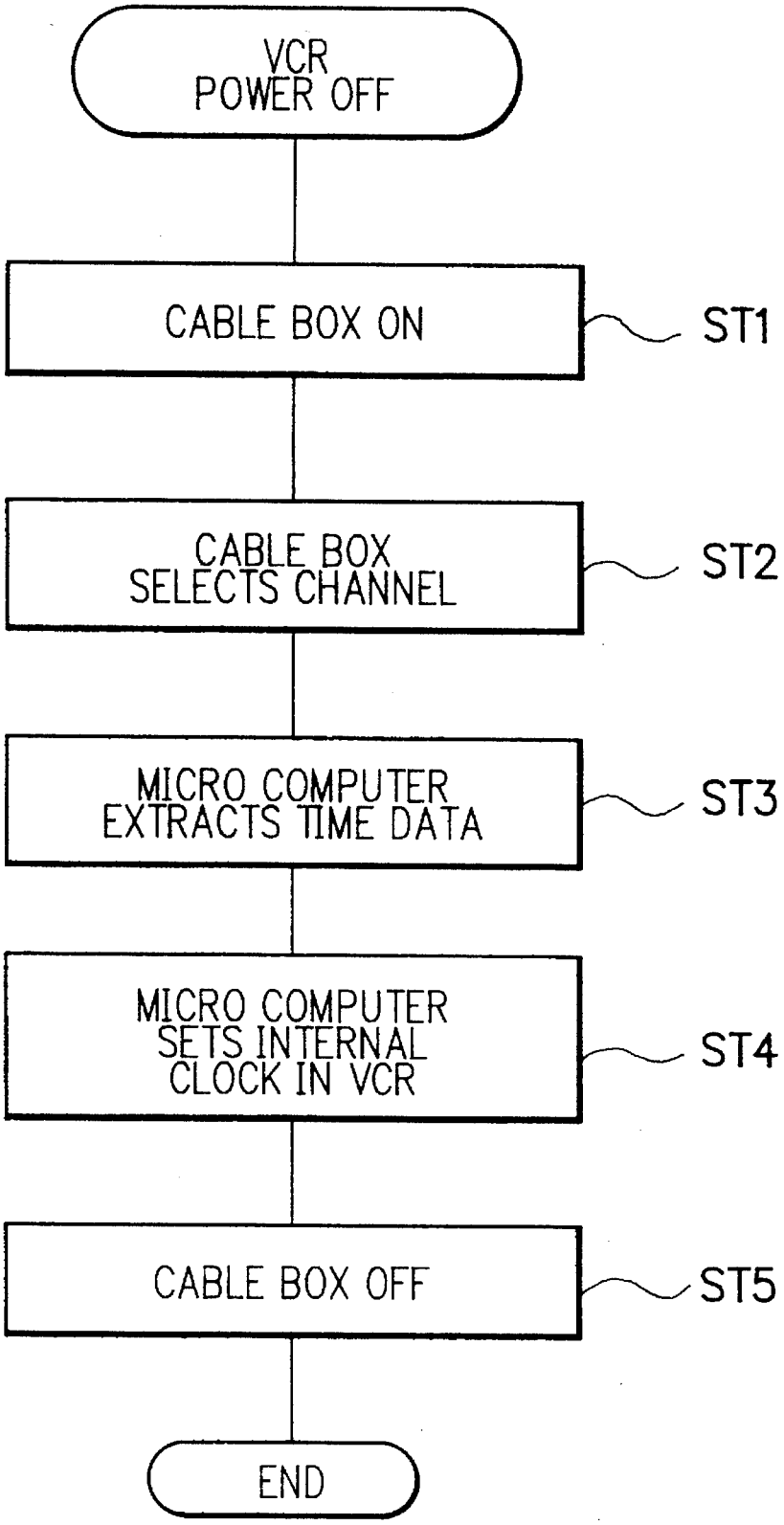
FIG. 3 is a flow chart of the operation of the broadcast signal receiver in accordance with the present invention.

FIG. 3 is a flow chart illustrating the operation of the broadcast signal receiver in accordance with the present invention and represents the instructions performed by microcomputer 22 of video tape recorder 2 for automatically setting the internal clock of video tape recorder 2. As shown, the operation of automatically setting the internal clock begins when video tape recorder 2 is manually turned off by a user, wherein cable box 1 is turned on in response to a control signal from remote control unit 4, as represented by instruction ST1. After cable box 1 is turned on, microcomputer 22 supplies a second control signal to cable box 1 via cable box controller 26 and remote control unit 4 instructing tuner 12 in cable box 1 to tune to a selected predetermined channel whose broadcast signal contains VBI data which includes time data, as shown by instruction ST2. As is appreciated, when cable box 1 is not present to receive broadcast signals, microcomputer 22 controls tuner 20 in video tape recorder 2 to tune to this predetermined channel. Then, as represented by instruction ST3, microcomputer 22 via data decoder 21 extracts the time data from the VBI data included in the received broadcast signal. In a preferred embodiment, the time data indicates Greenwich time or local time, and further indicates whether local time is daylight savings time or standard time. It is appreciated that the VBI data may contain both Greenwich time and local time, and may also contain the current calendar date (it is appreciated that a change from or to daylight savings time may be determined from the current calendar date and time). Microcomputer 22 sets the internal clock of video tape recorder 2 to the local time, as represented by instruction ST4, whereupon cable box 1 is turned off, as shown by instruction ST5.

It is appreciated that when a user turns off cable box 1 and video tape recorder 2, power nevertheless remains supplied to various components of video tape recorder 2 so that the internal clock may be automatically set, and upon completion of setting the internal clock, power may be removed. Since the operation of automatically setting the internal clock requires that time data be received and such time data is included only on selected broadcast signals, causing the tuner to tune to the selected broadcast signal while video tape recorder 2 is on (i.e., the user has not manually turned off video tape recorder 2) causes an undesirable change in the channel selection. Such a change in channel selection during the operation of video tape recorder 2 may cause either interrupted viewing of a selected channel or an interruption of the recording of a broadcast program. Accordingly, these undesirable interruptions are avoided by deferring the automatic setting of the internal clock control after the video tape recorder 2 is turned off.

Figure 4:
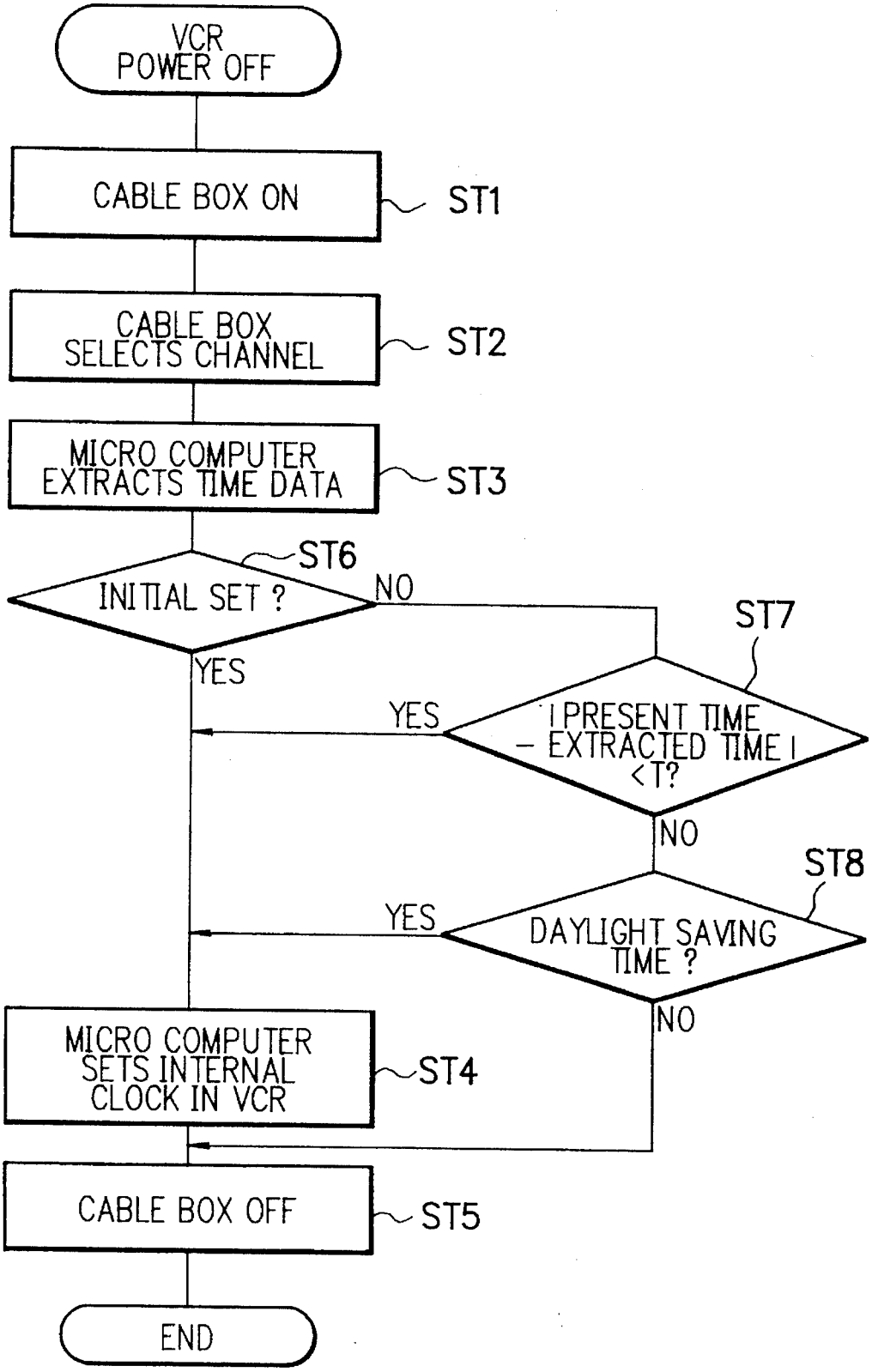
FIG. 4 is a flow chart illustrating the operation of another embodiment of the present invention.

FIG. 4 is a flow chart illustrating another embodiment of the broadcast signal receiver of the present invention, wherein those instructions shown in FIG. 4 which correspond to the same instructions shown in FIG. 3 are denoted by the same reference numerals. After video tape recorder 2 is turned off, cable box 1 is turned on and then controlled to tune to the predetermined channel whose broadcast signal contains the VBI (time) data. As before, the time data is extracted from the broadcast signal, as represented by instructions ST1, ST2, and ST3, respectively, in a manner similar to that described with reference to FIG. 3.

After the time data is extracted from the broadcast signal, microcomputer 22 determines whether the current operation of automatically setting the internal clock represents the initial setting of the internal clock, as represented by inquiry ST6. That is, microcomputer 22 determines if the internal clock was previously set. If it is determined that the current operation is the initial setting of the internal clock, then microcomputer 22 sets the internal clock to the local time, as represented by instruction ST4 and as has been described above. If not, microcomputer 22 determines whether the difference in time between the local time indicated in the extracted time data and the internal clock time is below a predetermined threshold level T (e.g., 10 minutes), as represented by inquiry ST7. If the determined difference is below the predetermined level T, microcomputer 22 sets the internal clock to the local time, as represented by instruction ST4. If the determined difference is not below the predetermined level T, for example, if the difference between the local time and the internal control time is greater than 10 minutes, microcomputer 22 then determines whether there was a change in the local time (as represented by the extracted time data) between daylight savings time and standard time, as represented by instruction ST8. If such a change is detected, microcomputer 22 sets the internal clock to the local time at instruction ST4. However, if there was no change from or to daylight savings time, cable box 1 is turned off, as represented by instruction ST5. Similarly, after completion of instruction ST4, cable box 1 is turned off.

In the embodiment illustrated in FIG. 4, the internal clock is set to the local time indicated in or derived from the extracted time data, except when the internal clock had been previously set, the difference between the internal clock time and the local time is greater than the predetermined level T, and there is no change from or to daylight savings time. These conditions, which result in not setting the internal clock to the local time, likely represent an incorrect local time due to "noise" or some other problem in the transmission of the VBI data. As previously discussed, the internal clock may indicate an incorrect time when there is a loss of power to the internal clock or there is incorrect time keeping by the internal clock, such situations resulting in the automatic setting of the internal clock to the local time after video tape recorder 2 is turned off. Further, an incorrect internal clock time due to a change in local time between daylight savings time and standard time also results in the automatic setting of the internal clock.

Figure 5:
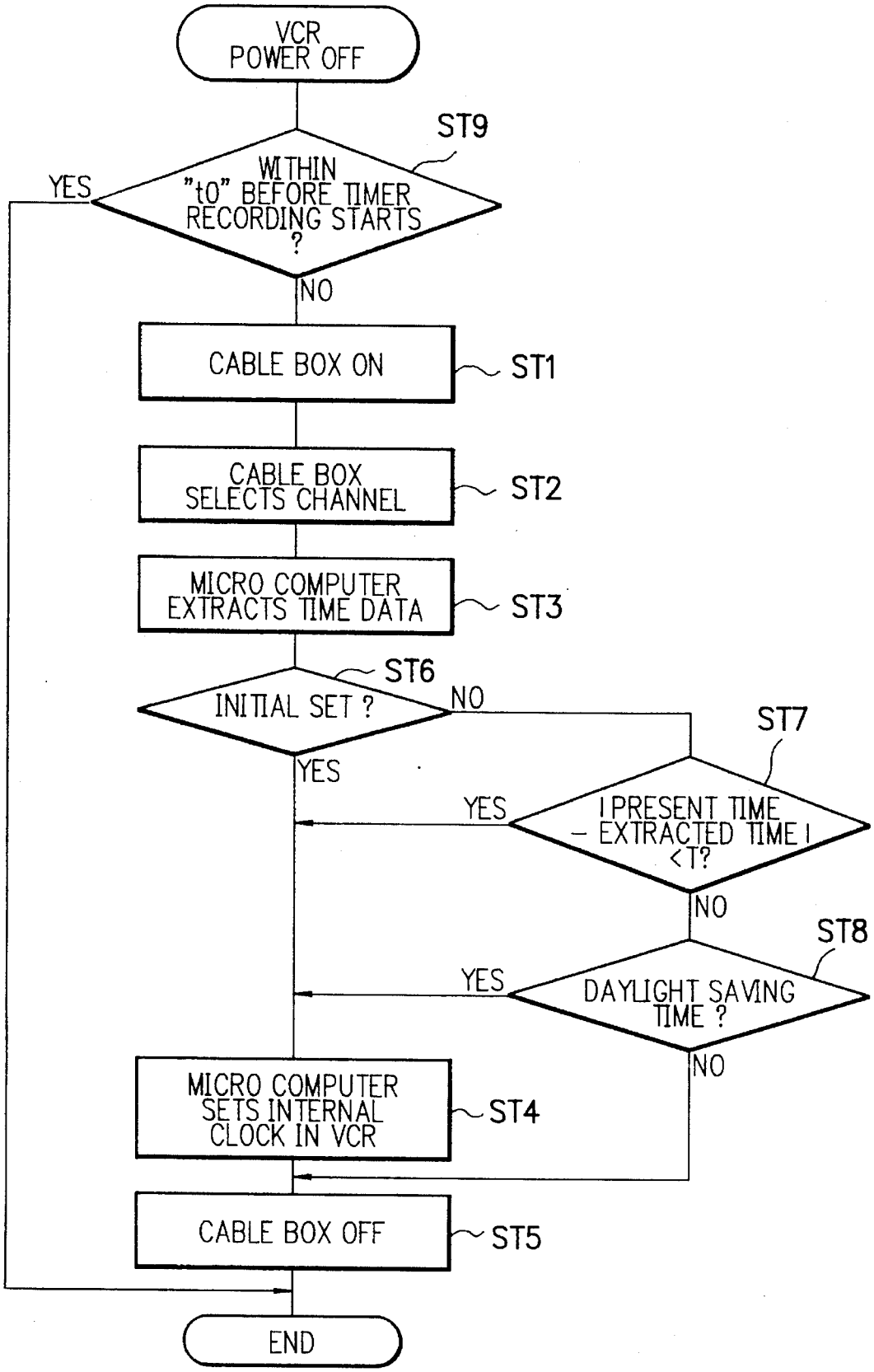
FIG. 5 is a flow chart illustrating the operation of a further embodiment of the present invention.

FIG. 5 is a flow chart of the operation of a further embodiment of the broadcast signal receiver of the present invention. As shown, the operation of automatically setting the internal clock to the local time is initiated when video tape recorder 2 is turned off, at which time microcomputer 22 determines whether the existing amount of time before a "preprogrammed" record setting begins recording is less than a predetermined time amount "t0" (e.g., 5 minutes), as represented by inquiring ST9. That is, microcomputer 22 determines the difference between the internal clock time and the "programmed time", wherein the programmed time represents the time at which the recording of a broadcast program is to begin. If it is determined that this difference in time is less than the predetermined time amount t0, the operation for automatically setting the internal clock terminates. However, if the calculated difference in time is greater than the predetermined time amount t0, cable box 1 is turned on, as represented by instruction ST1, and the operation of automatically setting the internal clock proceeds in the same manner shown in FIG. 4, previously described.

In the embodiment shown in FIG. 5, microcomputer 22 does not set the internal clock when video tape recorder 2 is about to begin recording. This prevents the internal clock from being set when there is a possibility that setting the internal clock may cause a "skipping over" of the programmed record start time.

In the above described embodiments, the operation of automatically setting the internal clock to the local time is initiated when video tape recorder 2 is turned off. However, it is appreciated that such operations may be performed at a fixed time of each day or at a fixed time and day of each month (or year) when video tape recorder 2 is not on (i.e., not being used). Further, such operations may be performed at a fixed time regardless of whether video tape recorder 2 is on or off. In addition, the above described embodiments provide that cable box 1 is controlled to tune to a selected predetermined channel. Accordingly, upon extracting the time data from the broadcast signal (instruction ST3), it may be advantageous to control cable box 1 to tune to the channel to which it was originally tuned prior to the initiation of the automatic setting operation.

Figure 6:
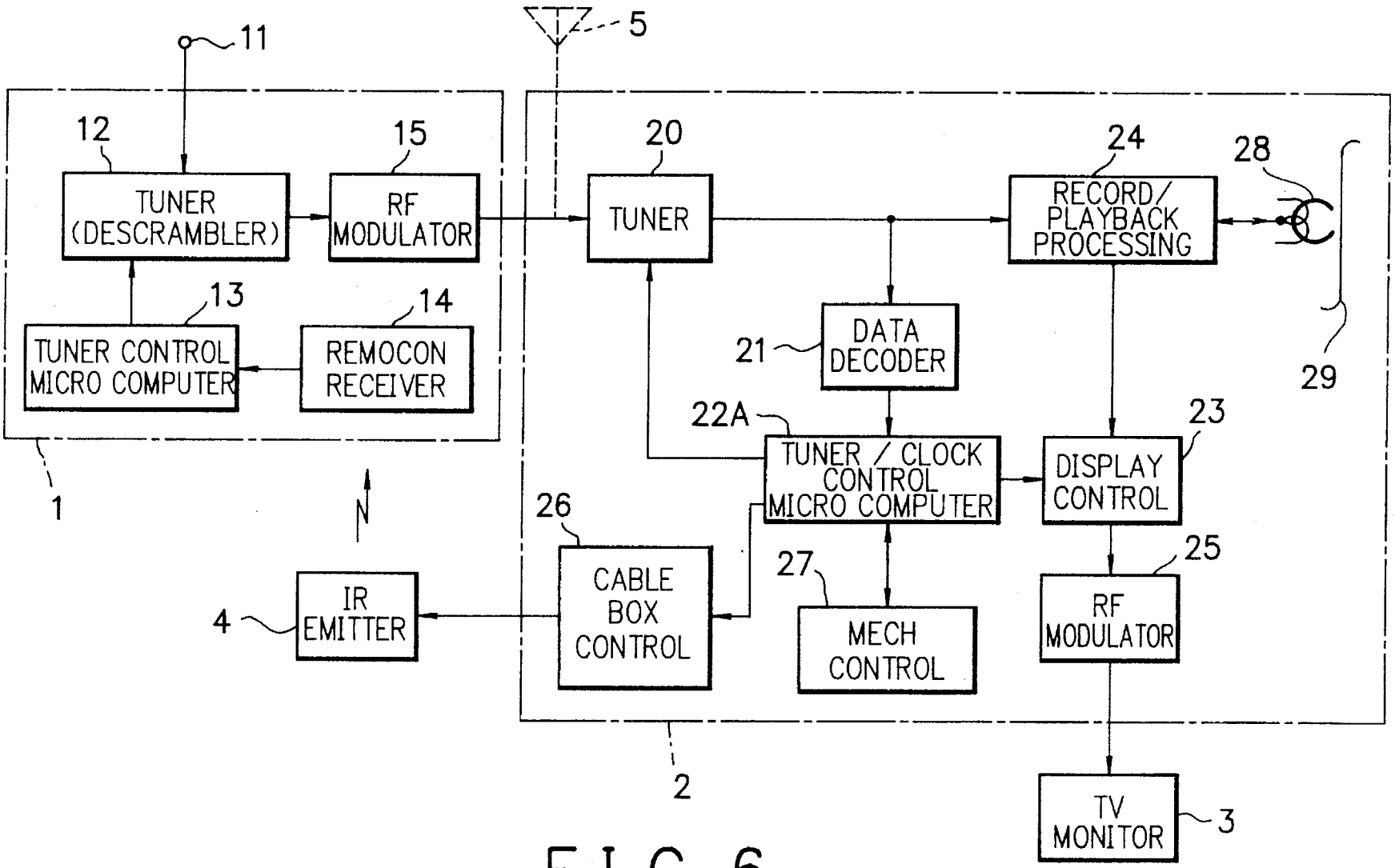
FIG. 6 is a block diagram of a cable box and a video tape recorder in accordance with another embodiment of the present invention.

FIG. 6 is another block diagram of a video tape recorder used with a cable box in which the present invention finds ready application, wherein VBI data contained in the broadcast signal includes time data which indicates a change between daylight savings time and standard time. The embodiment shown in FIG. 6 is the same in all respects to the embodiment shown in FIG. 1, except a microcomputer 22A responsive to a change between daylight savings and standard time controls the operation of video tape recorder 2, and therefore, the description of those parts shown in FIG. 6 that are also shown in FIG. 1 are omitted.

Figures 7A, 7B, 7C, 7D:
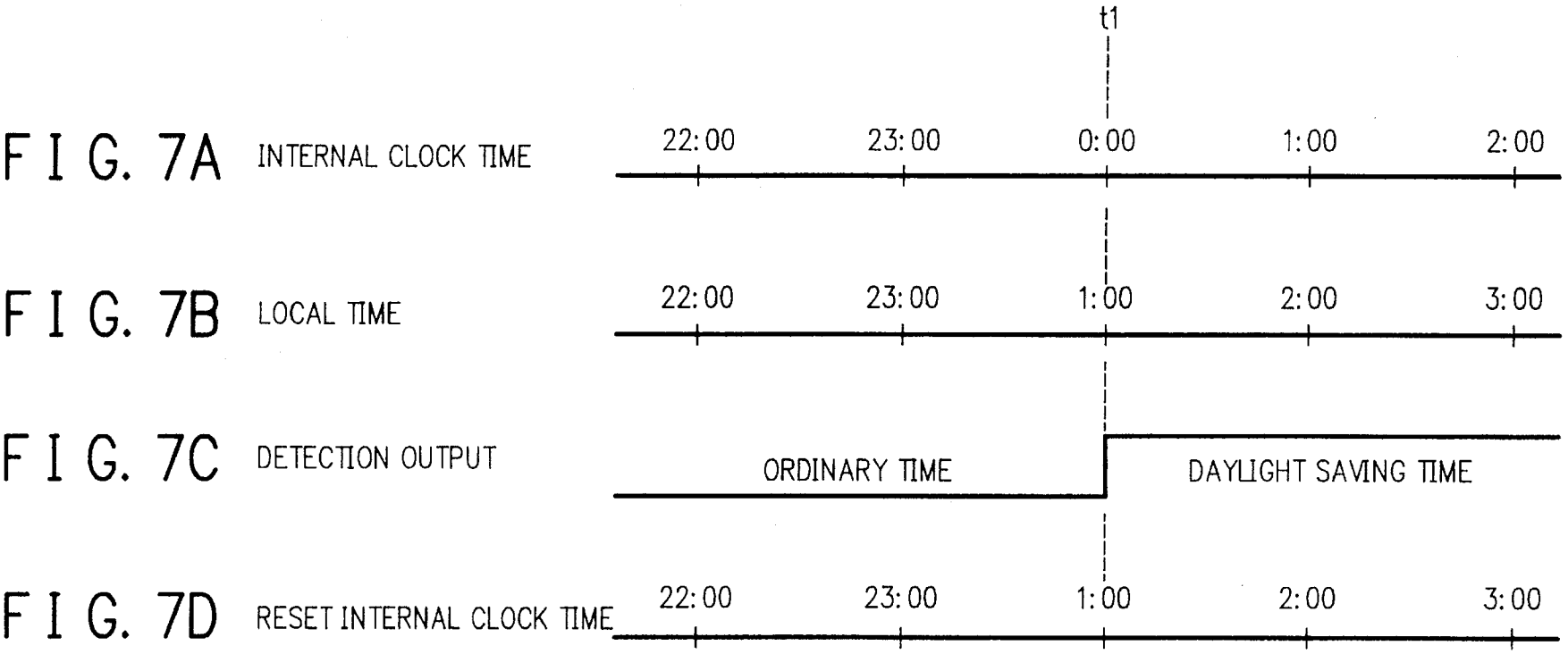
FIGS. 7A to 7D are time charts used to explain the operation of the present invention.

In the embodiment shown in FIG. 6, microcomputer 22A detects a change from or to daylight savings time based upon the time data in the VBI data. FIGS. 7A to 7D illustrate an example of the internal clock time and the local time when the local time changes from standard time (also known as ordinary time) to daylight savings time. As shown in FIGS. 7A and 7B, both the internal clock time and local time are the same at 22:00 (10:00 PM) and 23:00 (11:00 PM). However, at a time "t1", which indicates when there is a change from ordinary (standard) time to daylight savings time, as illustrated in FIG. 7C, the local time is 1:00 (AM) while the internal clock time is 0:00 (12:00 PM), thus resulting in an incorrect internal clock time of one hour. Microcomputer 22A detects this change from standard time to daylight savings time, and accordingly adjusts the internal clock to "gain" one hour at time t1. FIG. 7D illustrates the internal clock time after it is adjusted (i.e., reset). Microcomputer 22A similarly adjusts the internal clock when a change from daylight savings time to standard time is detected by setting the internal clock "back" one hour. It is appreciated that programmed recording operations are unaffected by a change of the internal clock time to either standard time or daylight savings time. However, it may be desirable to adjust a preprogrammed time of recording in a manner similar to the adjustment of the internal clock time when there is a change between standard time and daylight savings time. In this instance, the preprogrammed time is adjusted to "gain" one hour when the local time changes from standard time to daylight savings time, and is adjusted to "lose" one hour when the local time changes from daylight savings time to standard time. For example, the preprogrammed start time of recording is 2:30 PM and the preprogrammed stop time of recording is 3:30 PM, then the preprogrammed start time is changed to 1:30 PM and the preprogrammed stop time is changed to 2:30 PM when the local time changes from standard time to daylight savings time.

In another embodiment of the present invention, the operation of automatically setting the internal clock may be initiated after all of the programmed recording operations are complete.

In accordance with the present invention, automatically setting the internal clock ensures the proper timed operation of programmed record settings. In addition, the present invention operates well in areas utilizing daylight savings time since it obviates the additional need of having to reset the internal clock at these time changes.

While the present invention has been particularly shown and described in conjunction with preferred embodiments thereof, it will be readily appreciated by those of ordinary skill in the art that various changes may be made without departing from the spirit and scope of the invention. For example, while the operation of automatically setting the internal clock has been described in conjunction with a video tape recorder utilizing a cable box which receives broadcast signals, the present invention is not limited in use with a cable box and broadcast signals may be received directly via an antenna or other known broadcast signal receiving means, thereby obviating the cable box.

As another example, although the VBI data is described as being multiplexed on the video signal in a manner similar to the multiplexing of captioned data, the VBI data may be transmitted with the broadcast signal in other manners. Further, the present invention is not limited solely to VBI data with the disclosed format, but may utilize VBI data in other formats.

Still further, although the present invention is described in conjunction with a closed/captioned system, other systems, including a television receiver system, a radio receiver system and a satellite broadcast receiver system, may be utilized with the present invention.

Therefore, it is intended that the appended claims be interpreted as including the embodiments described herein, the alternatives mentioned above and all equivalents thereto.

What is claimed is:

1. Broadcast signal receiver having an internal clock indicating an internal clock time, comprising:

means for receiving a plurality of broadcast signals;

means for receiving a power-off command;

tuning means coupled to said means for receiving a plurality of broadcast signals and responsive to the reception of said power-off command tunable to a predetermined one of said broadcast signals having time data indicating a local time and supplying said predetermined one of said broadcast signals as a tuned output signal;

means coupled to said tuning means for extracting said time data from said tuned output signal;

clock setting means coupled to said means for extracting and responsive to said extracted time data for automatically setting said internal clock to said local time; and means for turning said broadcast signal receiver off when said power-off command is received and after said internal clock is automatically set.

2. The broadcast signal receiver of claim 1, wherein said clocking setting means sets said internal clock to said local time at a fixed predetermined internal clock time.

3. The broadcast signal receiver of claim 2, wherein said clocking setting means sets said internal clock to said local time at said fixed predetermined time only if said power-off command is received.

4. The broadcast signal receiver of claim 1, further comprising means for determining a difference between said internal clock time and said local time, and wherein said clock setting means sets said internal clock to said local time only when said determined difference is less than a predetermined threshold amount.

5. The broadcast signal receiver of claim 1, further comprising programmed recording means for recording received broadcast signals on a record medium at a programmed time.

6. The broadcast signal receiver of claim 5, further comprising means for determining a difference between said programmed time and said internal clock time and, wherein said clock setting means sets said internal clock to said local time only when said determined difference is greater than a predetermined threshold amount.

7. The broadcast signal receiver of claim 1, further comprising means for detecting a change in said local time between daylight savings time and standard time, and means for changing a programmed time in response to said change between daylight savings time and standard time.

8. The broadcast signal receiver of claim 1, wherein said clocking setting means sets said internal clock to said local time if said internal clock had not been previously set.

9. The broadcast signal receiver of claim 1, further comprising detecting means for detecting when said local time indicated by said time data changes from daylight savings time to standard time or from standard time to daylight savings time, and wherein said clocking setting means sets said internal clock to said local time when said change in said local time is detected by said detecting means.

10. The broadcast signal receiver of claim 1, wherein said clock setting means sets said internal clock to said local time when said internal clock time represents daylight savings time and said local time represents standard time.

11. The broadcast signal receiver of claim 1, wherein said clock setting means sets said internal clock to said local time when said internal clock time represents standard time and said local time represents daylight savings time.

12. The broadcast signal receiver of claim 1, wherein said time data indicates a change from standard time to daylight savings time, and said clock setting means sets said internal clock to said local time when there is a change to daylight savings time.

13. The broadcast signal receiver of claim 1, wherein said time data includes calendar data, the broadcast signal receiver further comprising means for identifying a change to daylight savings time in accordance with said calendar data, and wherein said clock setting means sets said internal clock to said local time when said means for identifying identifies said change to daylight savings time.

14. The broadcast signal receiver of claim 1, wherein said broadcast signal receiver is a video tape recorder.

15. Broadcast signal receiver having an internal clock indicating an internal clock time and being coupled to a tuner having tuning means controllably tunable to a selected one of a plurality of received broadcast signals and supplying said selected one of said plurality of received broadcast signals to said broadcast signal receiver, said broadcast signal receiver comprising:

means for receiving a power-off command;

channel selection means responsive to the reception of said power-off command for controlling said tuner to tune to a predetermined broadcast signal having time data indicating a local time;

means coupled to said channel selection means for receiving said predetermined broadcast signal from said tuner;

means coupled to said means for receiving said predetermined broadcast signal for extracting said time data from said predetermined broadcast signal;

clock setting means coupled to said means for extracting and responsive to said extracted time data for setting said internal clock to said local time indicated by said time data; and means for turning said broadcast signal receiver off when said power-off command is received and after said internal clock is automatically set.

16. The broadcast signal receiver of claim 15, further comprising means for turning said tuner on when said power-off command is received, and wherein said clock setting means sets said internal clock to said local time after said tuner is turned on.

17. The broadcast signal receiver of claim 16, wherein said channel selection means controls said tuner to automatically tune to said predetermined broadcast signal having said time data after said power-off command is received and said tuner is turned on, and controls said tuner to automatically tune to a previous broadcast signal to which said tuner was previously tuned when said broadcast signal receiver is turned off.

18. The broadcast signal receiver of claim 17, further comprising means for turning said tuner off after said clock setting means sets said internal clock to said local time.

19. The broadcast signal receiver of claim 15, wherein said channel selection means is a remote control device which remotely controls said tuner.

20. Method of setting an internal clock indicating an internal clock time in a broadcast signal receiver, comprising the steps of:

receiving a plurality of broadcast signals;

receiving a power-off command;

tuning to a predetermined one of said broadcast signals having time data indicating a local time when said power-off command is received;

extracting said time data from said tuned broadcast signal;

setting said internal clock to said local time indicated by said extracted time data; and turning said broadcast signal receiver off when said power-off command is received and after said internal clock is automatically set.

21. The method of claim 20, wherein said internal clock is set to said local time at a fixed predetermined internal clock time.

22. The method of claim 21, wherein said internal clock is set to said local time at said fixed predetermined time only if said power-off command is received

23. The method of claim 20, further comprising the step of determining a difference between said internal clock time and said local time, and wherein said internal clock is set to said local time only when said determined difference is less than a predetermined threshold amount.

24. The method of claim 20, wherein said broadcast signal receiver is operable to record a broadcast signal at a programmed time, said method further comprising the step of determining a difference between said programmed time and said internal clock time, and wherein said internal clock is set to said local time only when said determined difference is greater than a predetermined threshold amount.

25. The method of claim 20, wherein said internal clock is set to said local time if said internal clock had not been previously set.

26. The method of claim 20, further comprising the step of detecting when said local time indicated by said time data changes from daylight savings time to standard time or from standard time to daylight savings time, and wherein said internal clock is set to said local time when said change in said local time is detected.

27. The method of claim 20, wherein said internal clock is set to said local time when said internal clock time represents daylight savings time and said local time represents standard time.

28. The method of claim 20, wherein said internal clock is set to said local time when said internal clock time represents standard time and said local time represents daylight savings time.

29. Method of setting an internal clock indicating an internal clock time in a broadcast signal receiver which receives a broadcast signal from a tuner, the method comprising the steps of:

receiving a power-off command;

controlling said tuner to tune to a predetermined broadcast signal having time data indicating a local time when said power-off command is received;

extracting said time data from said predetermined broadcast signal;

setting said internal clock to said local time as indicated by said extracted time data; and turning said broadcast signal receiver off when said power-off command is received and after said internal clock is automatically set.

30. The method of claim 29, further comprising the step of turning said tuner on when said power-off command is received, and wherein said internal clock is set to said local time after said tuner is turned on.

31. The method of claim 30, wherein said step of controlling said tuner to tune to said predetermined broadcast signal having said time data is carried out after said power-off command is received and said tuner is turned on, the method further comprising the step of controlling said tuner to tune to a previous broadcast signal to which said tuner was previously tuned when said broadcast signal receiver is turned off.

32. The method of claim 31, further comprising the step of turning said tuner off after said internal clock is set to said local time.

33. Method of setting an internal clock indicating an internal clock time in a broadcast signal receiver, the method comprising the steps of:

receiving a power-off command;

receiving a broadcast signal having time data indicating a local time when said power-off command is received;

extracting said time data from said broadcast signal;

determining if said internal clock had been previously set;

determining a difference between said internal clock time and said local time;

determining from said extracted time data if said local time had changed between daylight savings time and standard time;

setting said internal clock to said local time indicated by said time data if said internal clock was previously set, or if said determined difference is less than a predetermined threshold amount, or if said local time had changed between daylight savings time and standard time; and turning said broadcast signal receiver off in response to said received power-off command.

34. The method of claim 33, wherein said broadcast signal receiver is operable to record a broadcast signal at a programmed time, said method further comprising the step of determining a difference between said programmed time and said internal clock time, and wherein said step of setting said internal clock is prevented when said determined difference is less than a predefined amount.

* * * * *